US007792467B2

(12) United States Patent
Stelter et al.

(10) Patent No.: US 7,792,467 B2
(45) Date of Patent: Sep. 7, 2010

(54) DUAL CHANNEL APPARATUS FOR TRANSPORTING POWDER IN AN ELECTROSTATOGRAPHIC PRINTER

(75) Inventors: Eric C. Stelter, Pittsford, NY (US); Joseph E. Guth, Holley, NY (US)

(73) Assignee: Eastman Kodak Company, Rochester, NY (US)

( * ) Notice: Subject to any disclaimer, the term of this patent is extended or adjusted under 35 U.S.C. 154(b) by 411 days.

(21) Appl. No.: 11/855,590

(22) Filed: Sep. 14, 2007

(65) Prior Publication Data

US 2009/0074469 A1 Mar. 19, 2009

(51) Int. Cl.
*G03G 15/08* (2006.01)

(52) U.S. Cl. ..... 399/256

(58) Field of Classification Search ..... 399/107, 399/119, 252–256

See application file for complete search history.

(56) References Cited

U.S. PATENT DOCUMENTS 5,260,159 A 11/1993 Ohtani et al.
6,121,986 A 9/2000 Regelsberger
6,480,689 B2 * 11/2002 Jacobs ..... 399/256
7,035,573 B2 * 4/2006 Yamaguchi et al. ..... 399/256
7,463,852 B2 * 12/2008 Yoshida et al. ..... 399/254
7,577,383 B2 * 8/2009 Brown et al. ..... 399/256

OTHER PUBLICATIONS

From "Direct extrusion with twin-screw extruders" by Charlie Martin in Plastics Machinery and Auxiliaries Nov. 2002http://www.pmamagazine.com/articles/2002/November/3magazine.com/articles/2002/November/3.

* cited by examiner

*Primary Examiner*—Hoan Tran
(74) *Attorney, Agent, or Firm*—Donna P. Suchy

(57) ABSTRACT

An apparatus and method for distributed mixing and transport of toner and powders in an electrostatographic printer containing at least powder and magnetic carrier. The apparatus includes a powder conveying apparatus for transporting powder in a developer station including a development station housing having two or more auger assemblies, each auger assembly including two or more screw augers supported in a channel profile. The two or more screw augers having multiple intermeshed screw blades and controlled by a conveyance controller. The conveyance controller is in communication with the powder the one or more augers, such that each auger preferentially mixes and transports in a first or second direction as the powder conveying device conveys the powder in the developer sump of a print engine.

20 Claims, 15 Drawing Sheets

DUAL CHANNEL APPARATUS FOR TRANSPORTING POWDER IN AN ELECTROSTATOGRAPHIC PRINTER

FIELD OF THE INVENTION

The invention relates to electrographic printers and apparatus thereof. More specifically, the invention is directed to an apparatus, including a dual channel developer sump, and method for transporting developer to an image device in an electrostatographic printer.

BACKGROUND OF THE INVENTION

Electrographic printers and copiers utilizing developer including toner, carrier, and other components use a developer mixing apparatus and related processes for mixing the developer and toner used during the printing process. The term "electrographic printer," is intended to encompass electrophotographic printers and copiers that employ dry toner developed on an electrophotographic receiver element, as well as ionographic printers and copiers that do not rely upon an electrophotographic receiver. The electrographic apparatus often incorporates an electromagnetic brush station or similar development station, to develop the toner to a substrate (an imaging/photoconductive member bearing a latent image), after which the applied toner is transferred onto a sheet and fused thereon.

As is well known, a toner image may be formed on a photoconductor by the sequential steps of uniformly charging the photoconductor surface in a charging station using a corona charger, exposing the charged photoconductor to a pattern of light in an exposure station to form a latent electrostatic image, and toning the latent electrostatic image in a developer station to form a toner image on the photoconductor surface. The toner image may then be transferred in a transfer station directly to a receiver, e.g., a paper sheet, or it may first be transferred to an intermediate transfer member or ITM and subsequently transferred to the receiver. The toned receiver is then moved to a fusing station where the toner image is fused to the receiver by heat and/or pressure.

In electrostatographic copiers and printers, pigmented thermoplastic particles, commonly known as "toner," are applied to latent electrostatic images to render such images visible. Often, the toner particles are mixed with and carried by somewhat larger particles of magnetic material. During the mixing process, the magnetic carrier particles serve to triboelectrically charge the toner particles. In use, the development mix is advanced, typically by magnetic forces, from a sump to a position in which it contacts the latent charge image. The relatively strong electrostatic forces associated with the charge image operate to strip the toner from the carrier, causing the toner to remain with the charge image. Thus, it will be appreciated that, as multiple charge images are developed in this manner, toner particles are continuously depleted from the mix a fresh supply of toner must be dispensed from time-to-time in order to maintain a desired image density. Usually, the fresh toner is supplied from a toner supply bottle mounted upside-down, i.e., with its mouth facing downward, at one end of the image-development apparatus. Under the force of gravity, toner accumulates at the bottle mouth, and a metering device, positioned adjacent the bottle mouth, operates to meter sufficient toner to the developer mix to compensate for the toner lost as a result of image development. Usually, the toner-metering device operates under the control of a toner concentration monitor that continuously senses the ratio of toner to carrier particles in the development mix.

It is well known that toner is a powdery substance that exhibits a considerable degree of cohesiveness and, hence, relatively poor flowability. Since the force of gravity alone does not usually suffice in causing toner to flow smoothly from the mouth of an inverted toner bottle, other supplemental techniques have been used to "coax" the toner from the bottle. For example, flow additives, such as silica and the like, have been added to the mix to reduce the troublesome cohesive forces between toner particles. See, e.g., the disclosure of U.S. Pat. No. 5,260,159 in which a "fluidization" agent is added to a developer mix in a development sump to assist the movement of developer therein. While beneficial to a more consistent flow of developer, such substances influence other performance attributes of the development process and their effectiveness is therefore constrained. Automatically operated stirring devices or augers mounted within a horizontally oriented toner container, and thumping or vibrating devices connected to such containers have also been used to urge toner from its rest position towards an outlet or exit port.

Development stations require replenishment of toner into the developer sump to replace toner that is deposited on the photoconductor or receiver. The toner and a magnetic carrier are mixed together uniformly to form an effective developer. In development stations utilizing carrier, this toner must be mixed uniformly with the carrier. The developer must be mixed and transported to a position where it can be in contact with the latent charged image. If the mixing and/or transport are inefficient or ineffective the printing process is compromised. This can lead to many problems from poor prints to no prints at all. In electrostatic development stations utilizing magnetically hard carrier with a permanent magnetic moment, this is especially challenging since the magnetic carrier is cohesive. Replenishment done at a single location in the developer sump has lead to high concentrations of low-charge toner in one area of the sump, which tends to produce a dark streak on the image or receiver, or produces non-uniform areas in an image. In addition it should be noted that, as the reproduction apparatus market has evolved from black and white copiers to process color printers, more development stations are required to fit into essentially the same amount of machine space. To do this, a more compact station is needed that still adequately mixes and transports developer material in as small a space as possible. Within this smaller volume allotted to the toning station, increased station capacity is also needed to increase the time interval between developer replacement as the speed is increased since the larger volume of developer material allows for higher takeout rates of marking particles while removing a smaller percentage of the available particles.

The present invention corrects the problems of non-uniform mixing, faster take-out speeds and reducing the size of the development station. The apparatus and related methods transport and mix the toner efficiently when needed maintaining the correct proportions necessary to produce the high quality prints or powder coatings required by consumer demand.

SUMMARY OF THE INVENTION

The invention is in the field of mixing apparatus and processes for electrographic printers and powder coating systems. More specifically, the invention relates to an apparatus and method for distributed mixing and transport of toner and powders, including toner in powder form as well as powder coatings and similar materials. The apparatus includes a powder conveying apparatus for transporting powder in a developer station including a development station housing having two or more auger assemblies, each auger assembly including two or more screw augers supported in a channel profile, the two or more screw augers in each auger assembly rotating in the same direction, having multiple intermeshed screw blades, and controlled by a conveyance controller. The augers can contain screw blades or paddles and can also contain flippers. The conveyance controller is in communication with the one or more augers, such that each auger preferentially mixes and transports in a first or second direction as the powder conveying device conveys the powder in the developer sump of a print engine.

DETAILED DESCRIPTION OF THE INVENTION

Figure 1:
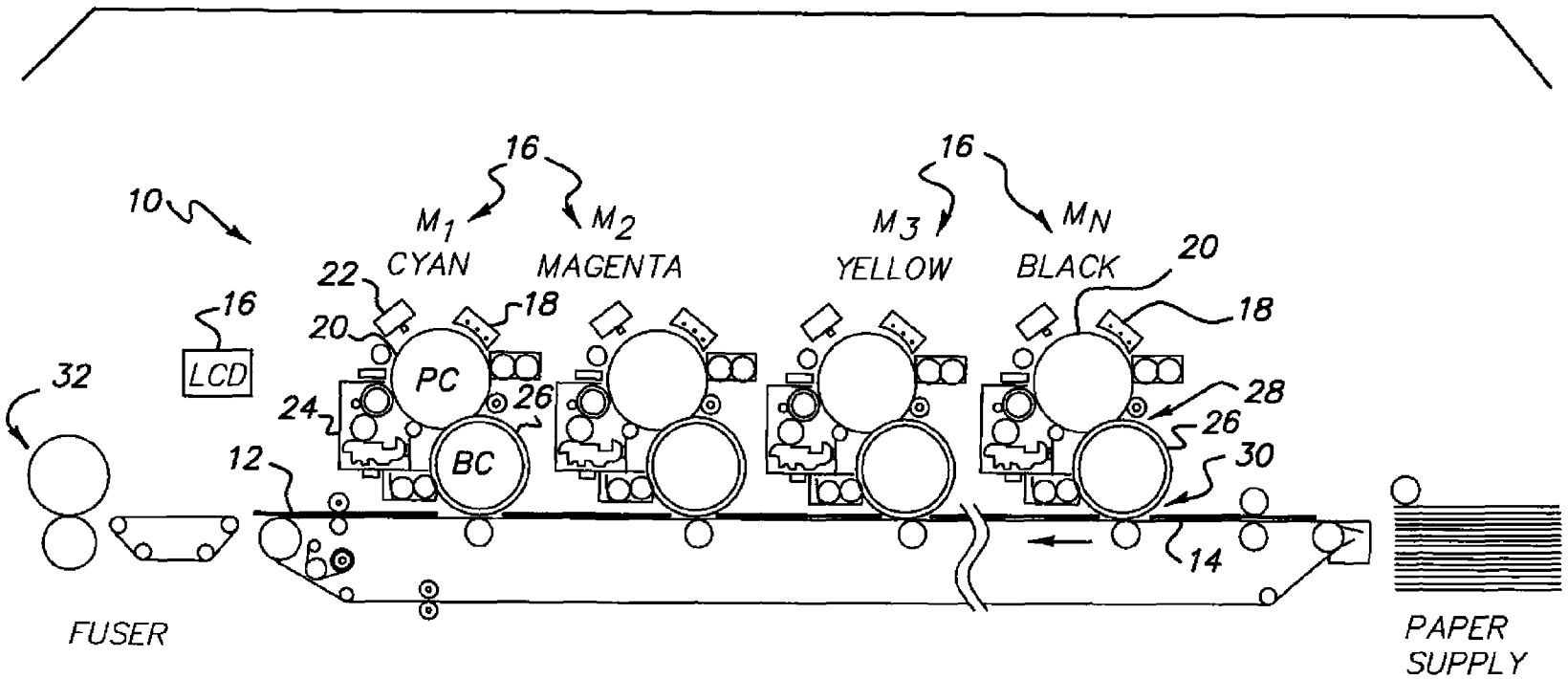
FIG. 1 is a schematic illustration, in cross-section, of a typical electrographic reproduction apparatus including a developer station.

FIG. 1 is a side elevational view schematically showing portions of an electrophotographic print engine or printer apparatus 10 suitable for printing multicolor toner images on receiver members or receivers 12. A plurality of colors may be combined on a single receiver member using electrographic printers. The term "electrographic printer," is intended to encompass electrophotographic printers and copiers that employ dry toner developed on an electrographic receiver element, as well as ionographic printers and copiers that do not rely upon an electrographic receiver. The color electrophographic printer shown in FIG. 1 employs a plurality of color toner modules (represented for reference only in FIG. 1 as M1-Mn), such as the CMYK toner system, in conjunction with printing on a substrate that travels along a transport web 14. Each of the modules generates a single-color or clear toner image or shape, such as a lens, for transfer to a receiver member successively moved through the modules. The modules can also be used to provide a clear toner overcoat.

The receiver 12 is advanced in the direction indicated by arrow P by a motor and/or web. Note that the substrate or receiver 12 may be any medium to be imaged and or coated such as a substrate, receiver or web. The receiver normally has a first and second opposite side such that the first side is the side upon which the first or only toner image is formed. One skilled in the art understands that the receiver could be paper that is printed or non-printed or a non-paper, such as metal, ceramics, photoconductor, textile, glass, plastic sheet, metal sheet, paper sheet and other bases that are capable of receiving a toner or toner related material. It will be understood that an optional supplementary source of heat for fusing, either external or internal, may be provided, directly or indirectly, to any roller included in a fusing station of the invention.

Each receiver 12, during a single pass by the modules, can have toner transferred in registration thereto, for a plurality of single-color toner or clear images or shapes to form a multicolor image with a clear toner overcoat or other desired application. As used herein, the term multicolor implies that in an image formed on the receiver member has combinations of subsets of primary colors combined to form other colors on the receiver member, at various locations on the receiver member. The primary colors participate to form process colors in at least some of the subsets, wherein each of the primary colors may be combined with one more of the other primary colors at a particular location on the receiver member to form a color different than the specific color toners combined at that location.

FIG. 1 also shows a representative Logic and Control Unit (LCU) 16 preferably a digital computer or microprocessor operating according to a stored program for sequentially actuating the workstations within printer machine 10, effecting overall control of printer machine 10 and its various subsystems. LCU 16 also is programmed to provide closed-loop control of printer machine 10 in response to signals from various sensors and encoders. Aspects of process control are described in U.S. Pat. No. 6,121,986 incorporated herein by this reference.

FIG. 1 shows representative color-printing modules. Each color-printing module ($M_n$) of the printer apparatus may include a plurality of electrophotographic imaging subsystems for producing a respective single-color toned image. These include a primary charging subsystem 18 for uniformly electrostatically charging a surface of a photoconductive imaging member 20, shown in the form of an imaging cylinder. Also included is an exposure subsystem 22 for image modulation of the uniform electrostatic charge by exposing the photoconductive imaging member to form a latent electrostatic color separation image in the respective color and a development subsystem 24 for toning the exposed photoconductive imaging member with toner of the respective color; an intermediate transfer member 26 for transferring the respective color separation image from the photoconductive imaging member through a transfer nip 28 to the surface of the intermediate transfer member 26, and through a second transfer nip 30 from the intermediate transfer member to a receiver member 12. All the modules are substantially identical to the above-described module. Some of the modules transfer a type of pigmented toner and others non-pigmented toner, such as a clear toner or some other transfer material or a combination of pigmented and non-pigmented toner. The receiver then travels along the path P to a fusing system 32 including a fuser that fuses the pigmented and non-pigmented toner.

Figure 2:
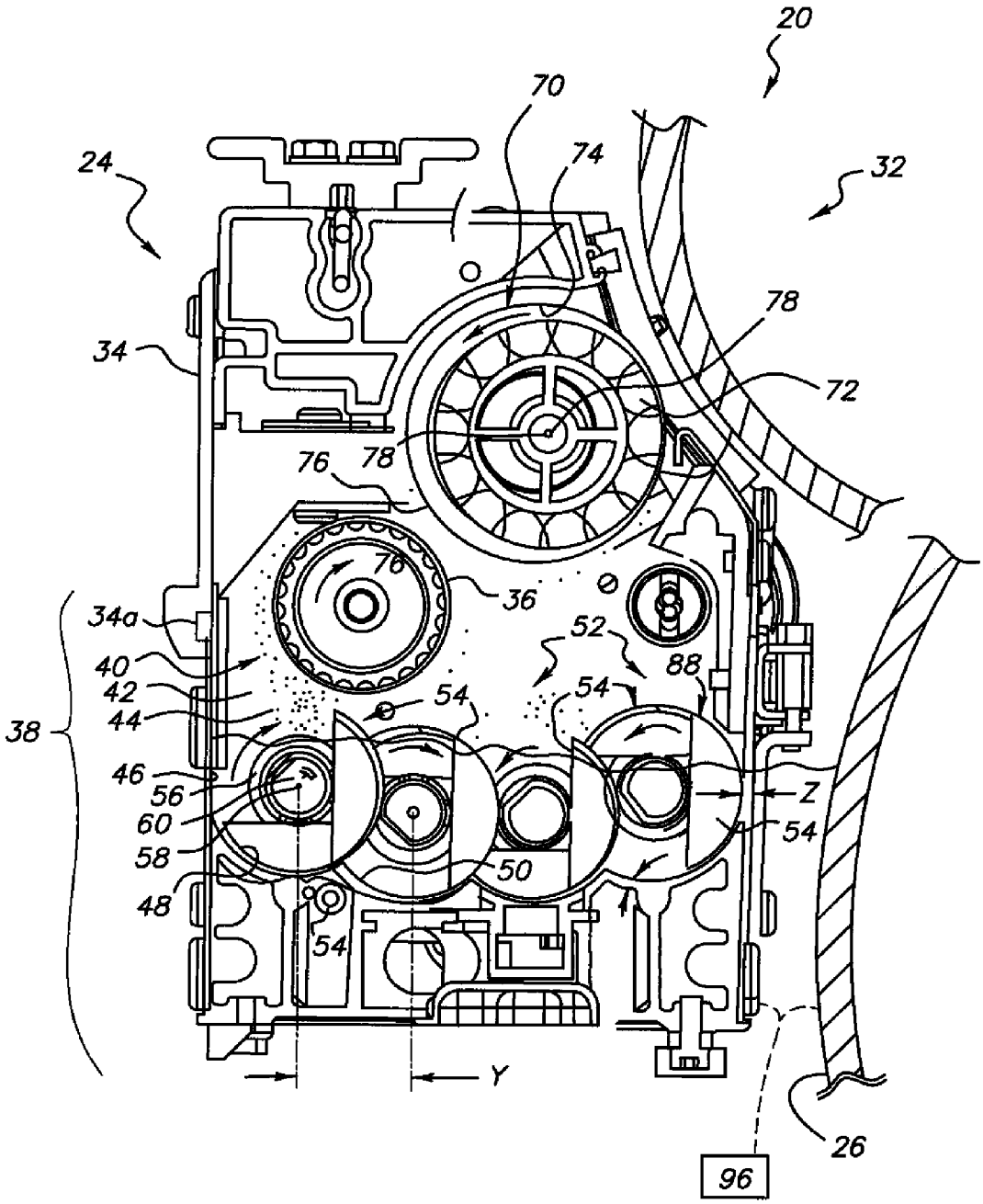
FIG. 2 is a cross-section on an enlarged scale of the reproduction apparatus magnetic brush developer station according to this invention.

The direct write subsystem 22 uses digital image data from a data source (that could come from the LCU or another source such as a memory device, internet connection, camera, scanner and other similar wired or wireless devices). The digital image or shape data, which may be represented by a line of pixels to be recorded is fed serially or in parallel to data storage registers on the electrographic write head in the write subsystem. The write subsystem may include a series of electrodes that extends across the imaging member 20, or alternatively any well-known Light Emitting Device (LED) array. For electrophotography, the write subsystem 22 exposes the uniform charge on the imaging member 20 and converts the uniform charge into a latent image or shape charge pattern corresponding to the data information from the data source. In the manner more fully described below, dry ink is applied by, for example, a magnetic brush developer station 24 to the latent image charge pattern on the imaging member 20 to develop the latent image into a dry ink image or shape. FIG. 2 shows the reproduction apparatus magnetic brush developer station, according to this invention, (also referred to as a developer station) designated generally by the numeral 24. The magnetic brush development station 24 includes a development station housing 34 next to a feed roller 36 to feed developer to the imaging member subsystem 20. The development station housing 34 defines a lower pant that forms, in part, a reservoir, also known as a sump, 38 for developer material 40 as it moves toward the feed roller 36. The developer material 40 includes a powder; such as pigmented or clear marking particles (dry ink), sometimes referred to as a toner, 42 that is triboelectrically attracted to ferromagnetic carrier particles 44 makes essentially two component developer 40.

The development station sump 38 has one or more sides or walls 46 and two or more channels 48, each having a channel profile 50 that forms a portion of the channel 48 to support a powder conveying device 52 including two or more auger assemblies 54 having two or more augers 56 such that the augers in each auger assembly rotate in the same direction but each pair of augers having multiple intermeshed screw blades that fit the channel profile and making up an assembly collectively rotate in an opposite direction from the adjacent auger assembly. The auger assembly can then preferentially mix the powder within the assembly in the mixing area and transport powder in a separate transport area in a preferred direction along the axis of the auger with minimal cross mixing between auger assemblies. This results in the powder-conveying device, including the two or more auger assemblies, intermixing in the assembly mixing areas while conveying the powder toward the feed apparatus. Each auger 56 has a shaft 58 with an axis 60. In one embodiment the channel 48 is a portion of the developer sump 38.

A development roller 70 is also mounted within the development station housing 34 including a rotating (counter-clockwise in FIG. 1) fourteen-pole core magnet 72 inside a rotating (clockwise in FIG. 1) shell 74. Of course, the core magnet 72 and the shell 74 can have any other suitable relative rotation. The quantity of developer material delivered is controlled by a metering skive 76, positioned parallel to the longitudinal axis 78 of the development roller 70, at a location upstream in the direction of shell rotation prior to the development zone. The metering skive 76 usually extends the length of the development roller 70 but the core magnet 72 does not necessarily need to extend the entire length of the development roller so the developer nap on the shell 74 does not necessarily extend to the end of the development roller.

The development station housing 34, having two or more channel profiles can be easily serviced by removing one or more of the augers 56. The rotatable shaft 58 is connected to each auger 56 to move the auger and thus helps transport and mix developer material within the development station-housing reservoir as described in more detail below. One or more sealing members (not shown) can be included, including a lip seal formed of a material which is able to stretch sufficiently to maintain contact with shaft 58 while the shaft is being rotated by a drive member (not shown). This assembly is robust to wear and any heat generation. Two or more bearings with a spacer in between are used so as to maintain minimum radial movement of the shaft 58 as well as an optimum spacing between augers in the assembly. The two or more bearings are fixed into the end plates, thus keeping radial spacing fixed. The shaft includes a feature for driving rotation and also a yoke to accept the end of the marking particles delivery auger. The shaft is hardened and ground to reduce wear and heat generation at the seal interface. The auger 56 is removeably attached to the shaft 58 by a flat on the shaft or with a pin or other attachment device. The washer and e-rings complete the assembly and hold it together, and can be removed by disassembling any drive mechanism, and then removing the assembly.

The development station housing 34 has a membrane-type seal placed over a hole 34*a* in the sidewall of the housing. The seal serves the purpose of providing pressure equalization within the housing. The surface area of the seal is selected to provide sufficient pressure equalization efficiency. The seal allows airflow, caused by pressure differential between inside the housing 34 and the exterior thereof, through the membrane without carrying developer material dust out of the housing. The seal is located in such a position as to cause developer material in the housing to continuously be moving across the membrane surface to continuously clean the membrane seal to maintain the efficient operation thereof.

Figure 3:
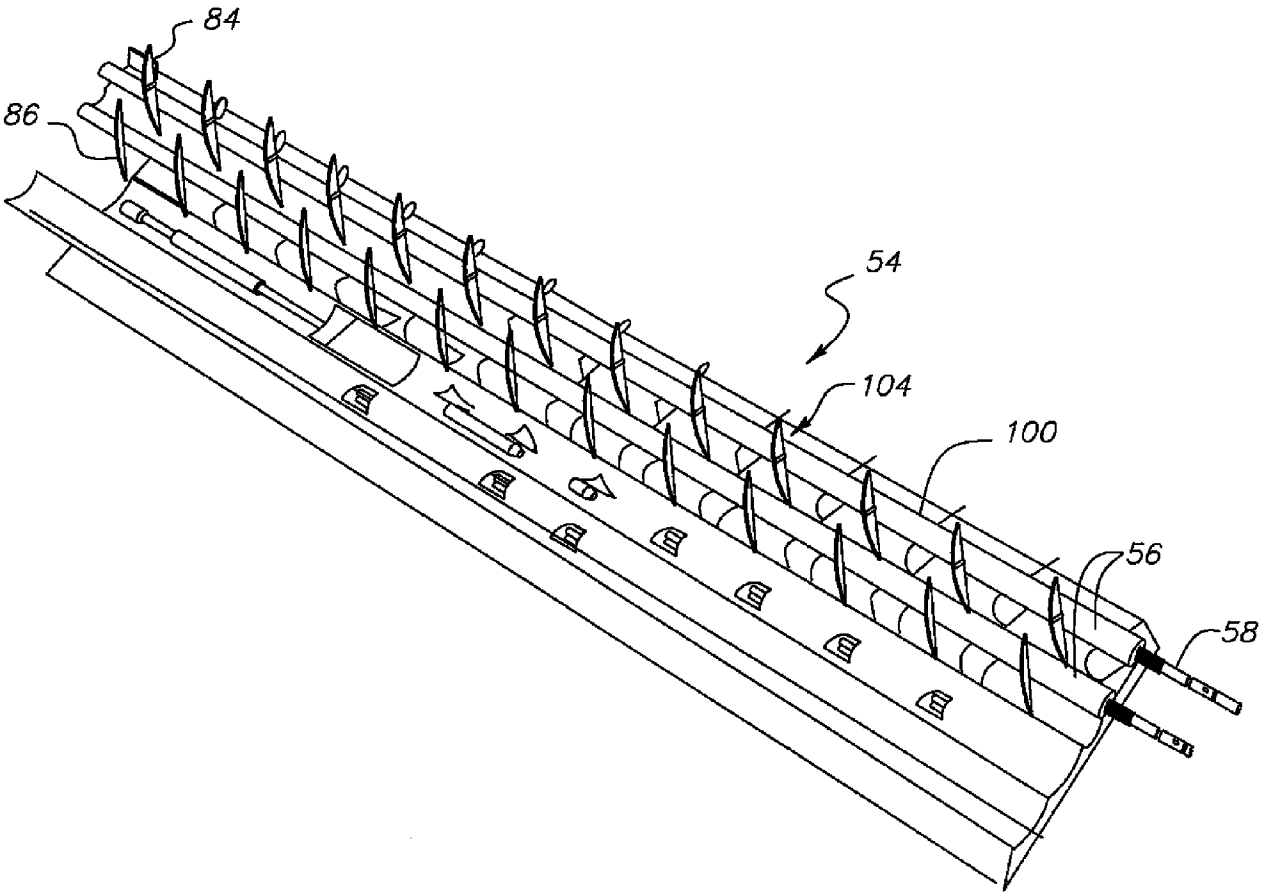
FIG. 3 is a side perspective view of an auger assembly of the magnetic brush development station of FIG. 1.

FIG. 3 shows a portion of the powder-conveying device 52 including one auger assembly 54. Each auger 56 has both flippers 84 and paddles 86, shown here as right-handed paddles, in specific combination on the one shaft 58. The (powder-conveying device could have either right or left-handed paddles as will be discussed in detail below and each shaft can have one or more flipper. Flippers primarily move developer away from the axis of the auger. The adjacent blades of the flippers in one embodiment are arranged on the shaft where the adjacent blades are offset between 90 and 180 degrees to each other. The flippers 84 are 1 mF structures on a shaft that predominantly flip the 2-component developer 40 (toner 42 plus magnetic carrier 44). The paddles 86 are structures on the same shaft 58 that predominantly transport the 2-component developer 40 down the axis of the shaft. The paddles 86, also referred to as blades, can be any suitable mixing paddles of any suitable material including metal, plastic and glass-like composites, or various combinations and in one embodiment the blades overlap each other an amount that is at least greater than 0 overlap up to where the blades are in contact with adjacent auger shaft. In one embodiment there is an overlap of 1 cm corresponding to 95% of the maximum distance x. In one embodiment the overlap 94 can vary between 0.5x and 0.95x.

In one embodiment, the paddle is angled at an angle that ranges from 20 40 degrees from a plane perpendicular to the axis of the auger shaft (corresponding to a helix angle of 20 to 40 degrees) and the relative blade or paddle orientation for adjacent blades or paddles ranges from 90 to 180 degrees in the direction of shaft rotation. Flippers are typically angled at an angle of 90 degrees from a plane perpendicular to the axis of the auger shaft, but this angle can range from 45 to 90 degrees. Also, the paddles and flippers must maintain their shape during operation and in the case of magnetic carrier the augers and paddles must be non-magnetic. For the most part the components must maintain the shape but there are instances were being somewhat flexible may be beneficial. Flexible components can reduce binding and or breakage of augers if the augers get slightly out of phase with each other.

The paddles stir the developer material 40 within the reservoir of the housing 34. The outside diameter 88 of this auger is typically spaced a distance Z from the inner wall 46 of the housing. The augers 56 in the auger assembly 54 are positioned in the housing 34 relative to the channels 48 such that the channel profile 50 fits that of each auger, specifically the outside diameter 88 of the auger, thus constraining and directing the developer 40. The powder is conveyed using the powder-conveying device discussed above, by rotating two or more assemblies in opposite directions, where collectively the augers of each assembly rotate in the same direction. The spacing between the two or more augers in each conveying device can preferentially mix in the assembly and transport in a preferred direction along the axis of the auger with minimal cross mixing between auger assemblies simply using auger rotation as the powder conveying device conveys the powder toward the feed apparatus.

Figure 4A:
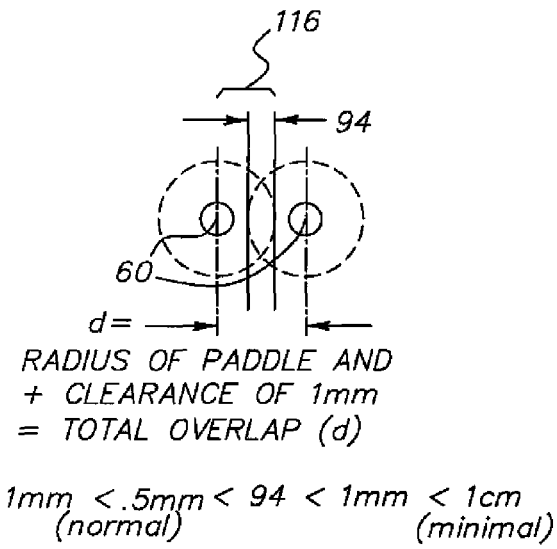
FIGS. 4*a* and 4*b* are schematic side views of a portion of the auger assembly of the magnetic brush development station of FIG. 1.
Figure 4B:
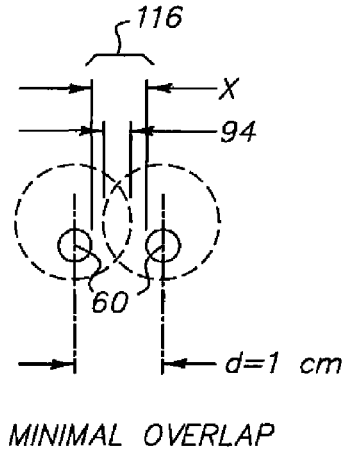
Figure 5:
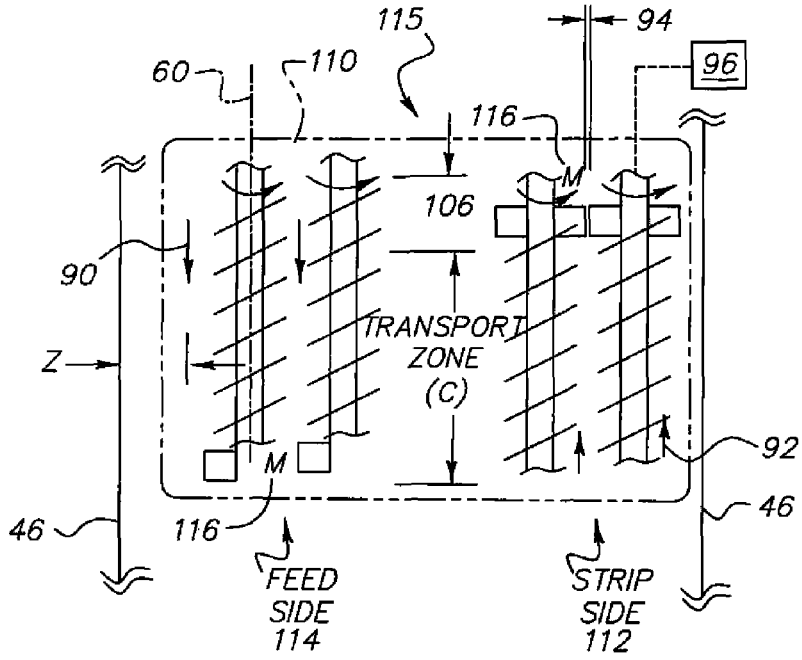
FIG. 5 is a schematic drawing of a top view of a powder conveyance device, including two auger assemblies, of the magnetic brush development station of FIG. 1.

As shown in FIGS. 4*a* and 4*b* and FIG. 5, the developer in each auger assembly 54 predominately flows in a first direction 90 or a second direction 92 generally parallel to the axis 60 of the auger shaft 58, as determined by the handedness of the paddles 86 on the auger 56 and the direction of rotation of the auger shaft 58. This requires the two or more augers in the auger assembly to operate in tandem, rotating in the same direction, thus the shape of the paddles and their spacing to each other is critical as well as the spacing of the paddles and flippers along the axis, as will be described in more detail below.

The augers are designed to have a set overlap 94 where the distance from auger shaft to auger shaft is x, as shown in FIG. 4. FIG. 5 shows two augers assemblies 54 spaced a distance z from the walls 46 and spaced apart from each other creating an intermediate zone 115. Within the two or more augers 56 making up each auger assembly the augers are spaced such that micro-mixing occurs between the paddles in a mixing area 116. Generally the intermediate zone 115 is a non-mixing zone, part of which is used to transport developer as will be discussed below. FIG. 5 is shown without a wall in the intermediate zone 115 but another embodiment could include a partial or full wall between the auger assemblies, preferably placed equidistance the assemblies.

The auger assemblies, as arranged in the powder-conveying device, do not need partitions between channels yet allow the better, more efficient and faster mixing and ultimately faster transport of correctly mixed developer while allowing a possibly more narrow device, particularly if all augers are not in the shape of a continuous helix. This saves space and allows the machines to print more quickly with the same quality of image without speeding up the augers the same amount as the printer. A prior art mixing station would have to be sped up to the extent that it would not be effective and probably would have to be much larger to accommodate the needs of a faster printer. Increasing the speed of the mixers too much can lead to turbulent mixing and excessive dusting of the toner from the development station housing. This in turn would degrade image quality.

Each auger assembly has a transport zone and in one embodiment the auger assembly may have both a transport zone or area and an extended mixing zone, also known as a mixing chamber, or mixing area adjacent a portion of the auger assembly referred to as a mixing portion of the auger assembly. The mixing portion decreases the mixing time constant due to the fact that the majority of mixing occurs in a specific region outside the imaging area, leading to more uniform toner concentration as it enters the imaging area. This may increase the length of the development station which is a negative when space, especially environmentally controlled space, is a premium in the new printer locations.

Figure 6B:
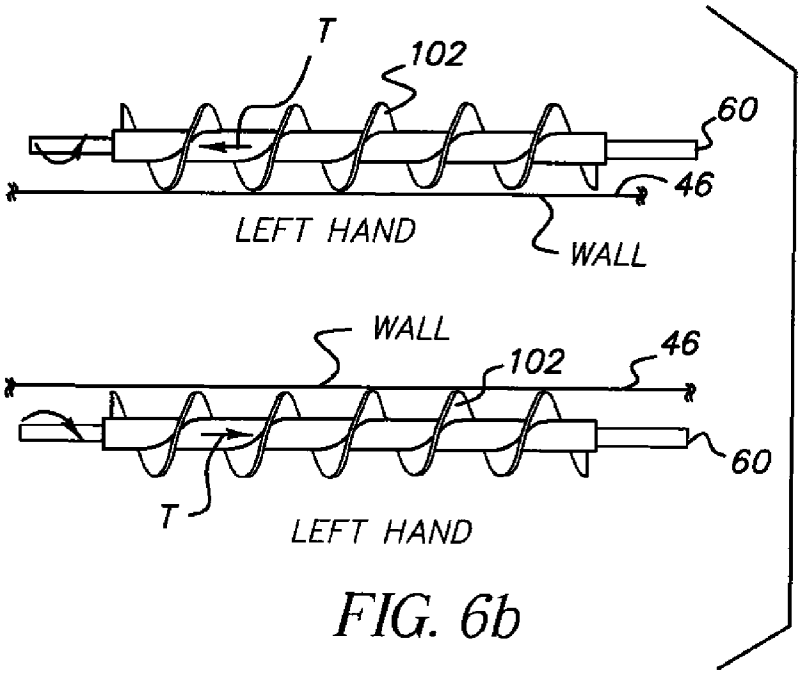
FIGS. 6*a* and 6*b* are top views, in perspective, of mixing augers of the magnetic brush development station of FIG. 1.
Figure 6A:
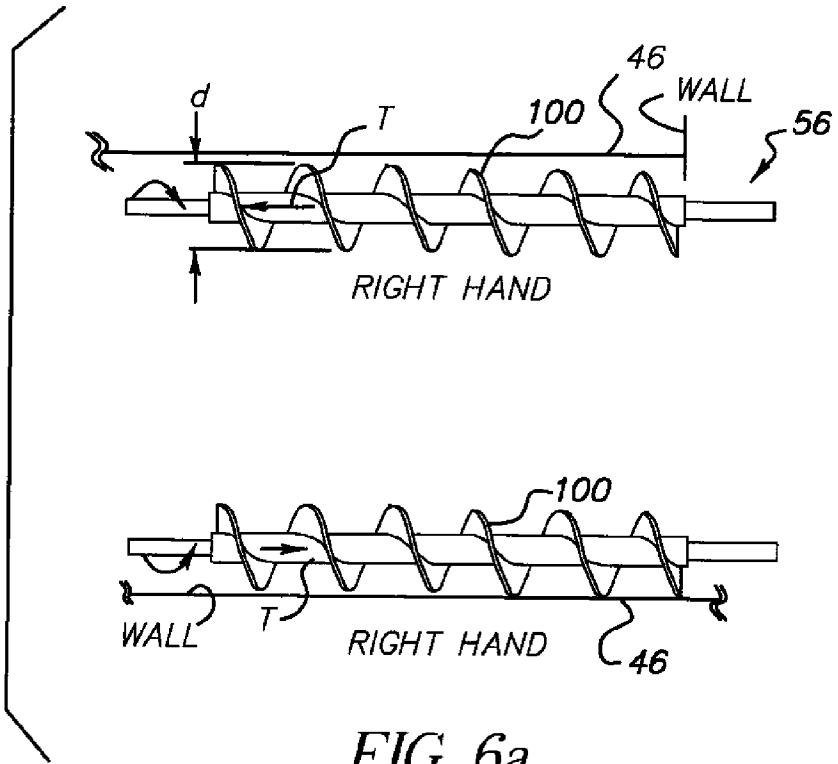

FIGS. 6*a* and 6*b* show a top view of one example of the auger 56 for the mixing of developer with fresh toner and the transport of the developer to the toning zone for image development. Augers may be a continuous helix, also known as a screw or a spiral. Augers may also be a discontinuous helix or an interrupted helix made up of individual parts that do not touch on the outer diameter. These augers consist of a shaft populated with blades (paddles), roughly semi-circular in shape that when populated on the auger shaft has an equivalent conveyance-housing diameter of 10 mm to 75 mm. The paddles are fixed at some angle (for example, 20 to 40 degrees), in one embodiment 30 degrees, with respect to a plane perpendicular to the axial centerline of the shaft.

In FIGS. 6*a* and 6*b* transport is primarily parallel to the shaft axis 60, but is also up the sump wall 46 adjacent to the auger 56. A portion of augers 56 or paddles 86 can form a segment of a right handed helix 100 or a left handed helix 102 as shown in FIGS. 6*a* and 6*b*. Paddles 86 can form an interrupted helix 104, as shown by the augers 56 in FIG. 3. The helical portions of both continuous and discontinuous or interrupted augers can be represented by the continuous right hand helix 100 or by the continuous left hand helix 102 shown in FIG. 6.

The preferred orientation of handedness and shaft rotation for an auger 56 to move developer parallel to the shaft axis 60 also moves developer upwards against an adjacent wall 46. If, for example, an auger 56 is populated with paddles forming a right-handed helix 100, looking along the auger axis 60 in the direction of developer transport T, the auger will be rotating counterclockwise from right to left, or right side rotating up, left side rotating down) and the developer 40 will be fed upwards against the wall 46 on the right side of the auger 54 in addition to being transported along the auger axis 60. Alternatively if an auger is populated with left-handed paddles 102, looking along the axis of the auger in the direction of developer transport, the auger 56 will be rotating clockwise (from left to right, or left side rotating up, right side rotating down) and the developer 40 will be fed upwards against the wall 46 on the left side of the auger 56 in addition to being transported along the auger axis 60.

The auger assembly 54 has a mixing zone 106, as shown in FIGS. 4 and 5, where developer 40 is mixed back and forth between augers 56 by flippers 84. In one preferred embodiment the auger assemblies 54 forms a racetrack 110 (see FIG. 5) that has two sides where the first side 112 could be a strip side to receive developer stripped from the development roller, which includes carrier depleted of toner and a second side 114 that can be a feed side where developer 40 is replenished with toner 42 and is fed to the development or feed roller 36. The developer 40 essentially moves around the racetrack 110. The strip side is also referred to as the return side. At the downstream end of each auger 56, flippers 84 move the developer to the adjacent channel 48.

FIGS. 6*a* and 6*b* show one example of the helical portion of the auger 56 for the mixing of developer with fresh toner and the transport of the developer to the toning zone for image development. These augers usually include a shaft populated with blades (paddles), roughly semi-circular in shape that when populated on the auger shaft has an equivalent conveyance-housing diameter of 10 mm to 75 mm. The paddles are fixed at some angle (for example, 20 to 40 degrees), in one embodiment 30 degrees, with respect to a plane perpendicular to the axial centerline of the shaft. Paddles are also used at the end of the shaft and also in the mixing zone.

Figure 7:
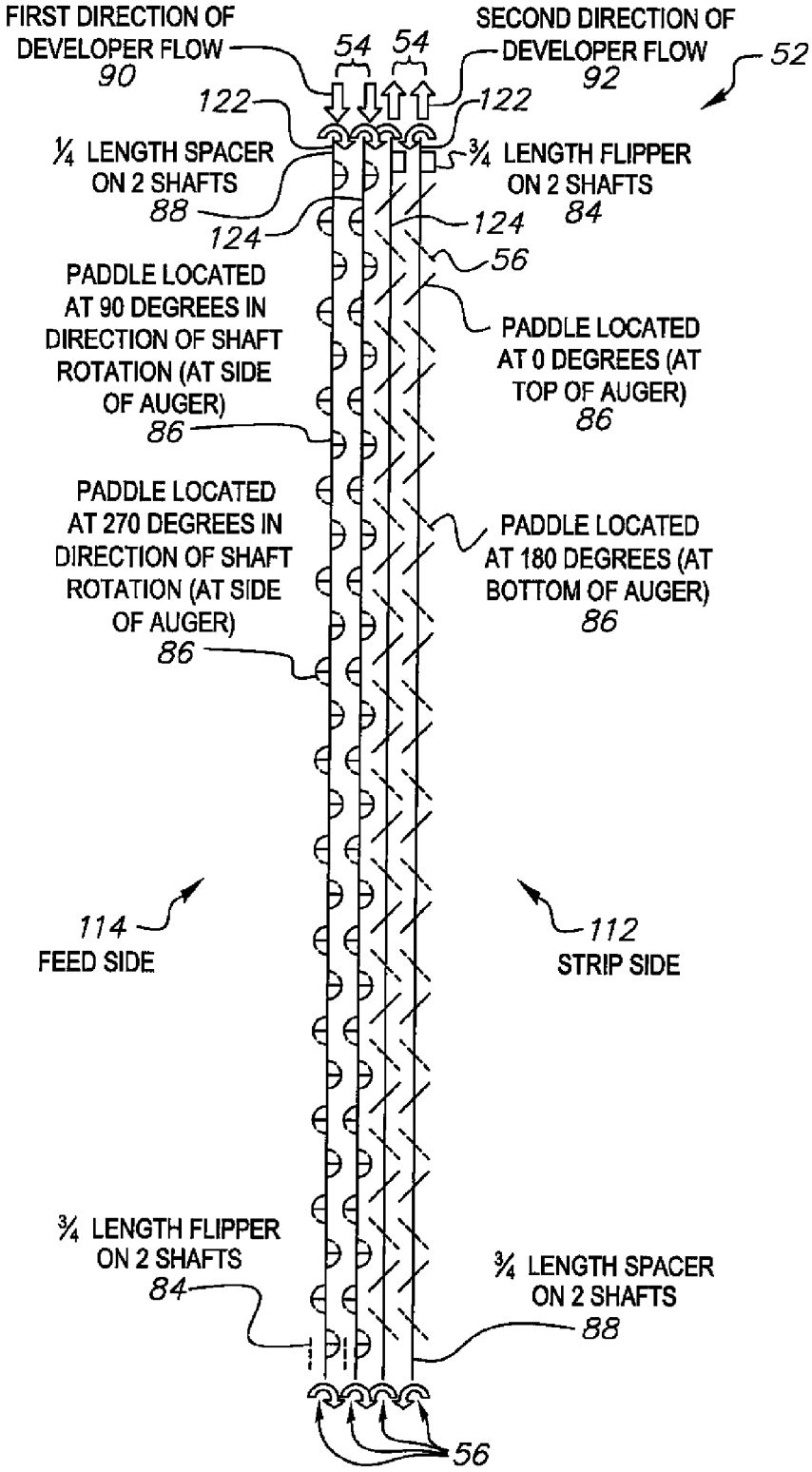
FIG. 7 is a top view schematic of one embodiment of the present invention with each auger having an identical configuration of paddles and flippers that differ only in orientation of the auger

FIG. 7 shows one embodiment of the powder conveyance device 52, a portion of the magnetic brush development station 24, according to this invention, including the auger assembly 54. Each auger assembly 54 has two or more augers 56 with multiple intermeshed screw paddles 86 and flippers 84. Each auger in FIG. 7 has an identical configuration of paddles and flippers, and the augers differ only in orientation. In one embodiment the multiple intermeshed screw paddles 86 are arranged such that all the paddles 86 or blades have the same pitch such that the auger assemblies 54 are offset ½ of a paddle length and also offset by a phase angle of 90 degrees, as shown, at one instant during the rotation of the shafts. A short flipper 84, or a short paddle 86, or a spacer 88 with a length that is a fraction of the length of a standard flipper or paddle can be used to produce the required offset between augers 56 or auger assemblies 54.

The dual channel auger sump without a dividing wall as shown in FIG. 7 has two inner augers 124, one from each auger assembly, that are made of blender segments 180° apart. In other words, along the axis of the auger, the paddles are arranged at relative angles of 0 degrees, 180 degrees, and 0 degrees. As shown in FIG. 7, the inner augers 124 are out of phase by 90° with each other momentarily during the rotation of the auger shafts, as well as offset in the direction of the shaft axis by ½ paddle length. The outer augers 122, one from each auger assembly, can be twins of the adjacent center augers. The outer augers teed developer in a direction 90 or 92 along the axis of each auger and also feed the developer against the adjacent wall 46 shown in FIG. 2 and FIG. 6 so that it moves up the wall for pick up by the feed roller 36 as shown in FIG. 2. FIG. 7 shows these features that can be used as described in this application or combined with other features as described in the application Ser. No. 11/680,166 by Ken Brown filed Feb. 28, 2007 and entitled "Apparatus and Method for Transporting Powder to an Image Device of an Electrostatographic Printer" as well as the application Ser. No. 11/742,092 by Ken Brown, filed 30 Apr. 2007 entitled "Powder Transport with a Tapered Feed Roller of an Electrostatographic Printer", both of which are incorporated by reference.

The conveyance controller 96 can control the one or more augers 56 such that the powder-conveying device 52 preferentially mixes and transports while conveying the powder 40 toward the feed apparatus or development roller 70. Although a different number or augers 56 or auger assemblies 54 could be used, powder flow would be more difficult to balance if the numbers were not even and equal.

The augers 56 in the powder conveying device, both paddles and flippers can both mix and transport as the powder 40 is conveyed toward the feed apparatus 70. This has two main advantages; it increases the time between developer changes. As a result of better and more efficient mixing, mixer speeds can be lowered, which in turn does not agitate the developer as much as at a faster speed. This allows for a longer dwell time for the developer and if, during the process of mixing and transporting developer, the material dwells and is thus "mixed" for a longer period of time while being transported along the length of the powder conveying device, the replenished developer material is in the reservoir a longer time and this improves material charging. The tribocharging of the material occurs along the length of the powder-carrying device, thus material dispersion, because of the more efficient mixing of toner, is more uniform by the time it reaches the transporting mechanism. This aids in reducing dusting, and because of better charging, the toner is more strongly attracted to the carrier particle. Therefore the toner particles are not as likely to come out of the powder-carrying device as airborne toner dust.

The powder conveyance device 52, according to this invention, provides for replenishing the housing reservoir with a fresh supply of marking particles for the developer material as required. Replenishment at a single point in the mixing zone allows for greater total throughput of material while maintaining a minimal amount of fresh marking particles being added near the feed to the developer roller. This continuous mixing allows the marking particles to be mixed into the developer material much more quickly and subsequently triboelectrically charged much more quickly. This aids in reducing dusting and maintaining a uniform concentration of marking particles throughout the sump. In another embodiment, the controller 96 that controls the augers 56 in the powder-conveying device 54 can also control the intermeshing of the blades 86 by moving the auger axis 60 relative to each other, thus increasing and decreasing the closeness of the intermeshing of blades 86 that are intermeshed as required. Increasing the amount of intermeshed blades can increase mixing while decreasing the amount of intermeshing will allow for faster transportation of powder and can minimize powder blockage or even stoppages.

In this embodiment and in others the powder conveying device 52 can be adapted by changing the plane the augers are in relative to each other so all axes are not in same plane. For example the axis of the outer augers can be at a lower plane than the axis of the inner augers to achieve more efficient transport and decrease the height of the development station since this would place the augers near the wall at a position that could be moved closer to the feed roller. This could also result in less cross mixing between the feed and strip channels, more developer on the outside augers (closer to wall) for improved transport of material and better feed roller pickup due to higher sump level on the wall adjacent the strongest part of the feed magnets. The phase offset between auger assemblies, as seen in a top view, for example, is adjusted to prevent binding or interference if the auger assemblies are not coplanar.

Figure 8:
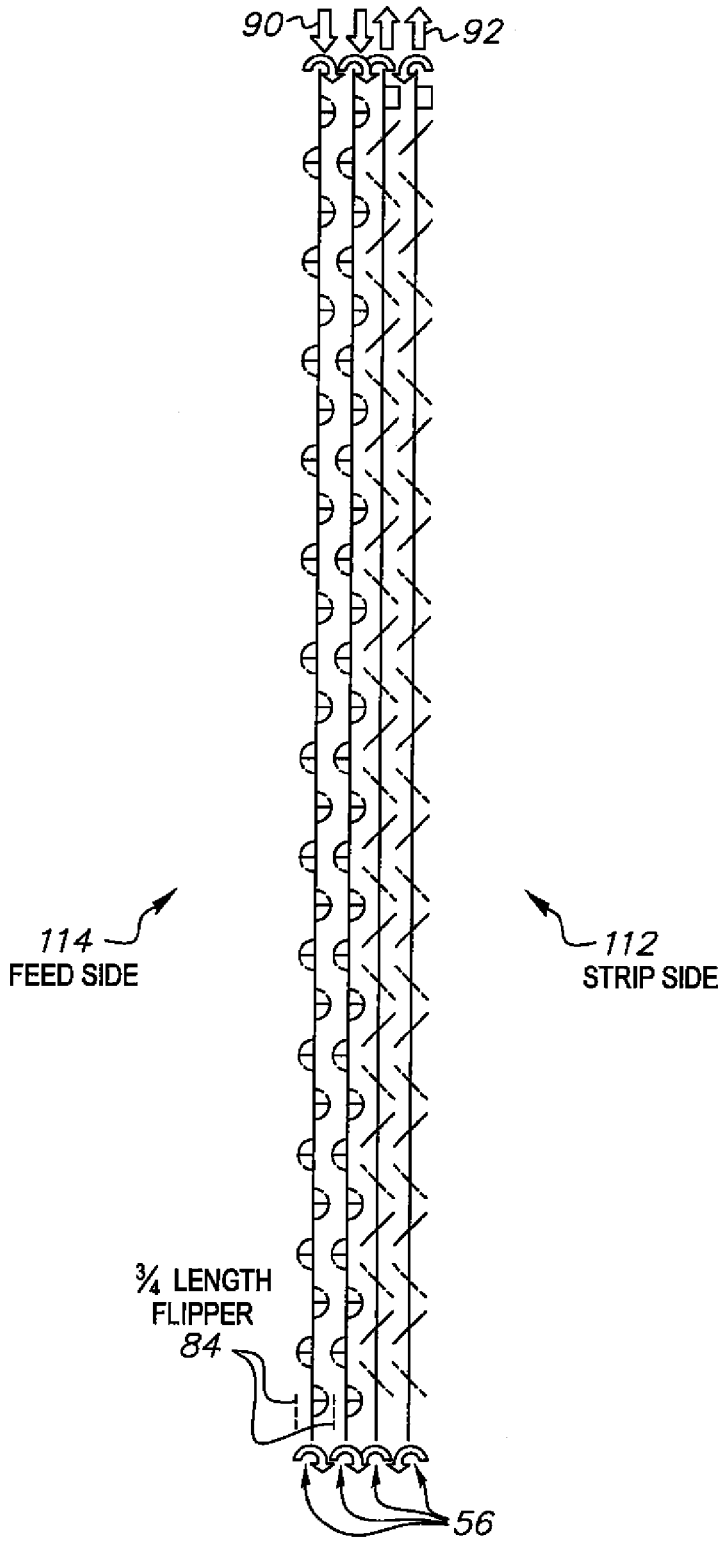
FIG. 8 is a top view schematic of one embodiment of the present invention with the flippers in the feed side rotated 180 degrees with respect to the adjacent paddle.

Another embodiment of this invention is shown in FIG. 8. This configuration differs from that shown in FIG. 7 by the orientation of the indicated flippers 84 in the feed side. They are rotated 180 degrees in the direction of shaft rotation from the adjacent edge of the last paddle to allow the end of the feed channel to be filled with developer before the flipper moves it toward the adjacent channel. The powder conveying apparatus 52, according to this embodiment of the invention, has no specific mixing chamber. Single point replenishment is used at the end of the return channel or at the beginning of the feed channel, and the mixing occurs primarily during the transporting of the developer. Alternately, extended replenishment along the return channel can be used. The mixing produced by the intermeshing paddles on adjacent shafts in each auger assembly is particularly useful for powders that require low shear mixing. The embodiment shown in FIG. 8 does not have a separate mixing chamber because sufficient mixing can be obtained by the augers alone in each half of the system. This embodiment provides low shear mixing of materials, particularly advantageous for chemically prepared toner with homogeneous size particles.

Figure 9:
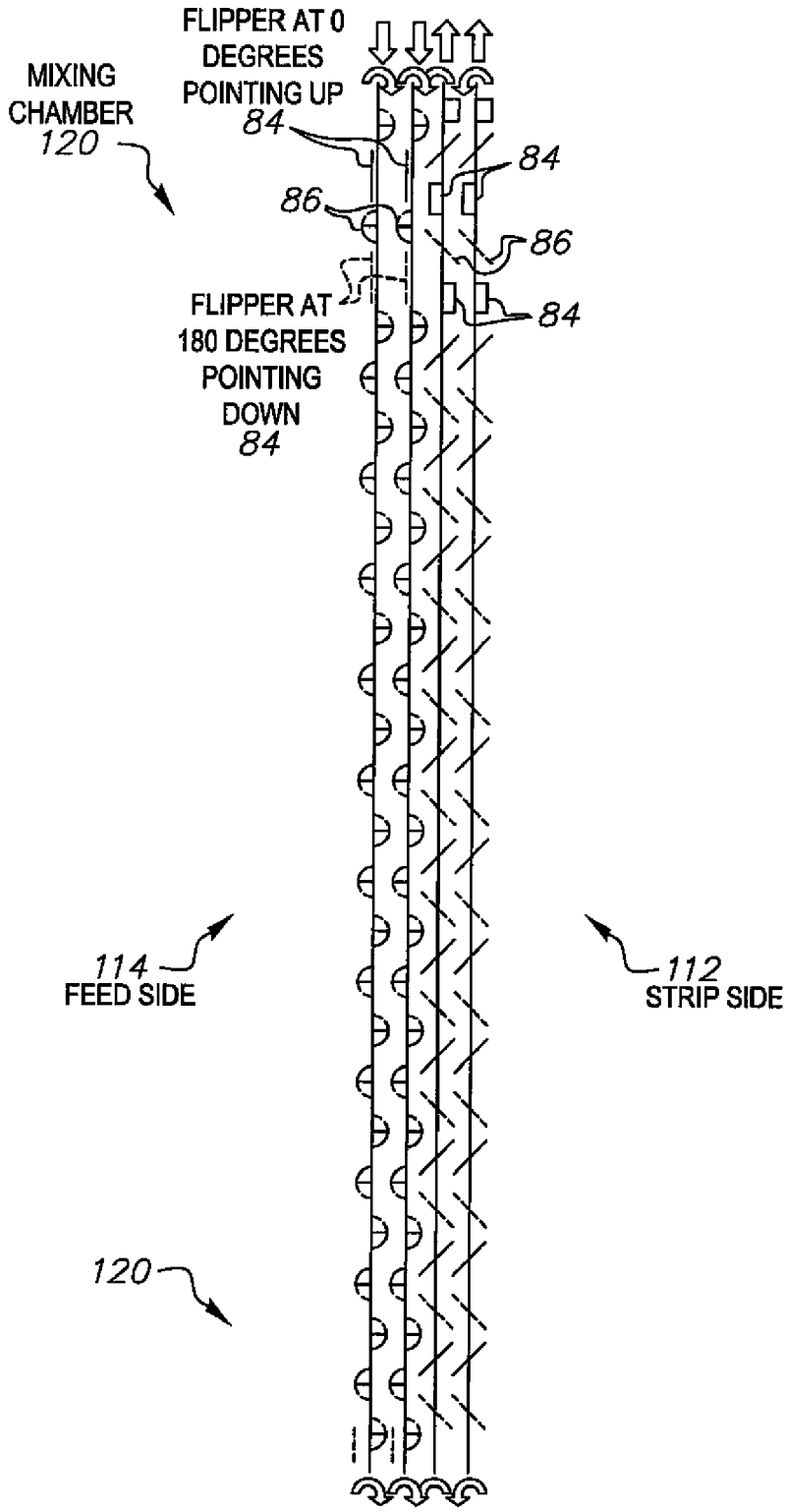
FIG. 9 is a top view schematic of one embodiment of the present invention with a mixing zone containing flippers alternating with paddles

Another embodiment of this invention shown in FIG. 9 which shows the powder conveying apparatus 52, according to this embodiment of the invention. The embodiment shown in FIG. 9 contains a mixing chamber 120. The mixing chamber preferably extends beyond the end of the toning roller 70 so that mixing does not occur adjacent the image. The mixing zone contains the indicated flippers 84 alternating with the indicated paddles 86 and arranged so that the adjacent edges of flippers and paddles are as close as possible. In other words, along the axis of the auger in the mixing chamber, a paddle at 0 degrees is followed by a flipper at 90 degrees, a paddle at 180 degrees, and a flipper at 270 degrees.

Figure 10:
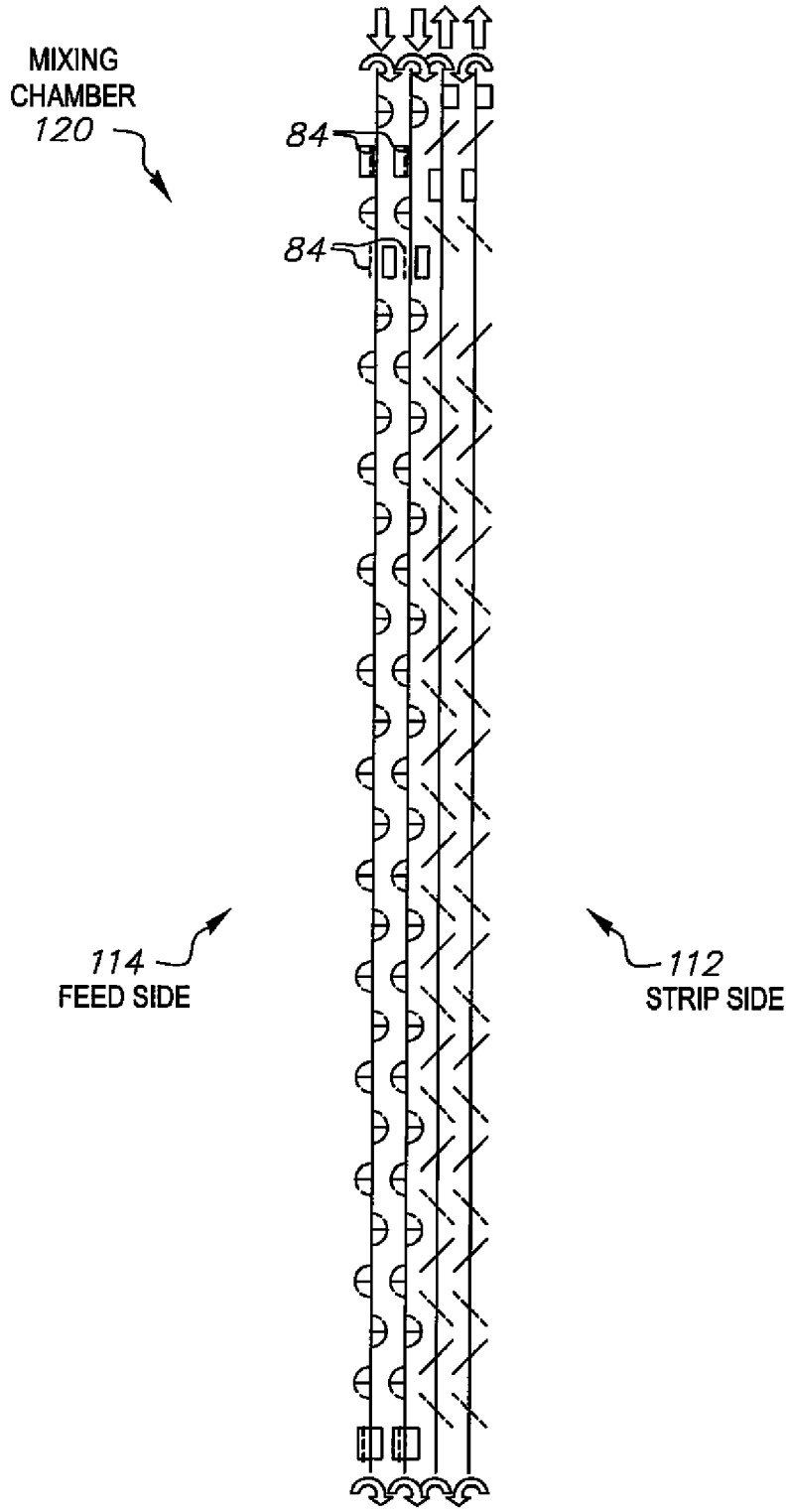
FIG. 10 is a top view schematic of one embodiment of the present invention.

Another embodiment of this invention is shown in FIG. 10. The powder conveying apparatus 52, according to this embodiment of the invention, has the indicated paddles 84 in the mixing zone in the feed side that are all rotated by 180 degrees or 270 degrees in the direction of shaft rotation compared to the configuration shown in FIG. 9. The indicated paddles 84 at the other end of the teed side are all rotated either 90 degrees, 180 degrees, or 270 degrees from the configuration shown in FIG. 9. The embodiment shown in FIG. 10 is similar to FIGS. 8 and 9 but provides more robust mixing and shows how the flippers for identical augers in each auger assembly can be modified to increase or decrease flipping. This can be done to balance flow in the sump so that developer does not collect at the end of each channel, to increase mixing in the mixing zone between the feed side and the return side, for example to compensate for high printing speeds, or to decrease mixing, for example to reduce dusting. Both a right hand or left-hand auger segment could be used and the circulation as seen from the top for right handed augers would be counterclockwise. Any left handed auger segments would provide clockwise circulation.

Figure 11:
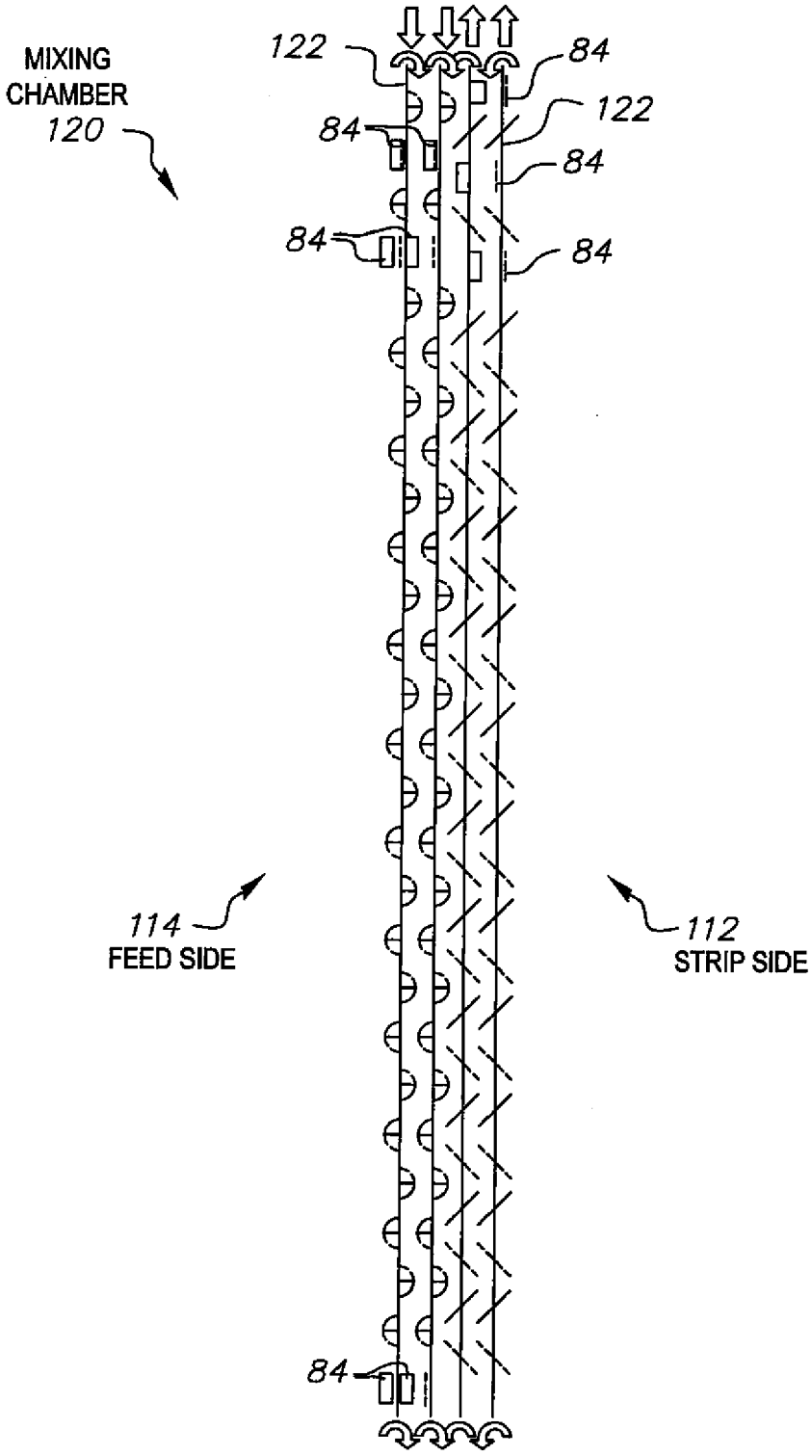
FIG. 11 is a top view schematic of one embodiment of the present invention.

Another embodiment of this invention is shown in FIG. 11. The powder conveying apparatus 52, according to this embodiment of the invention, has the indicated flippers 84 in the outer auger of the feed side adjusted +/−90 degrees from the inner auger of the feed side. The indicated paddles in the outer auger of the return side can be adjusted similarly. This shows how paddles can be adjusted in one auger relative to an adjacent auger in the same auger assembly to increase or decrease the movement of developer.

Figure 12:
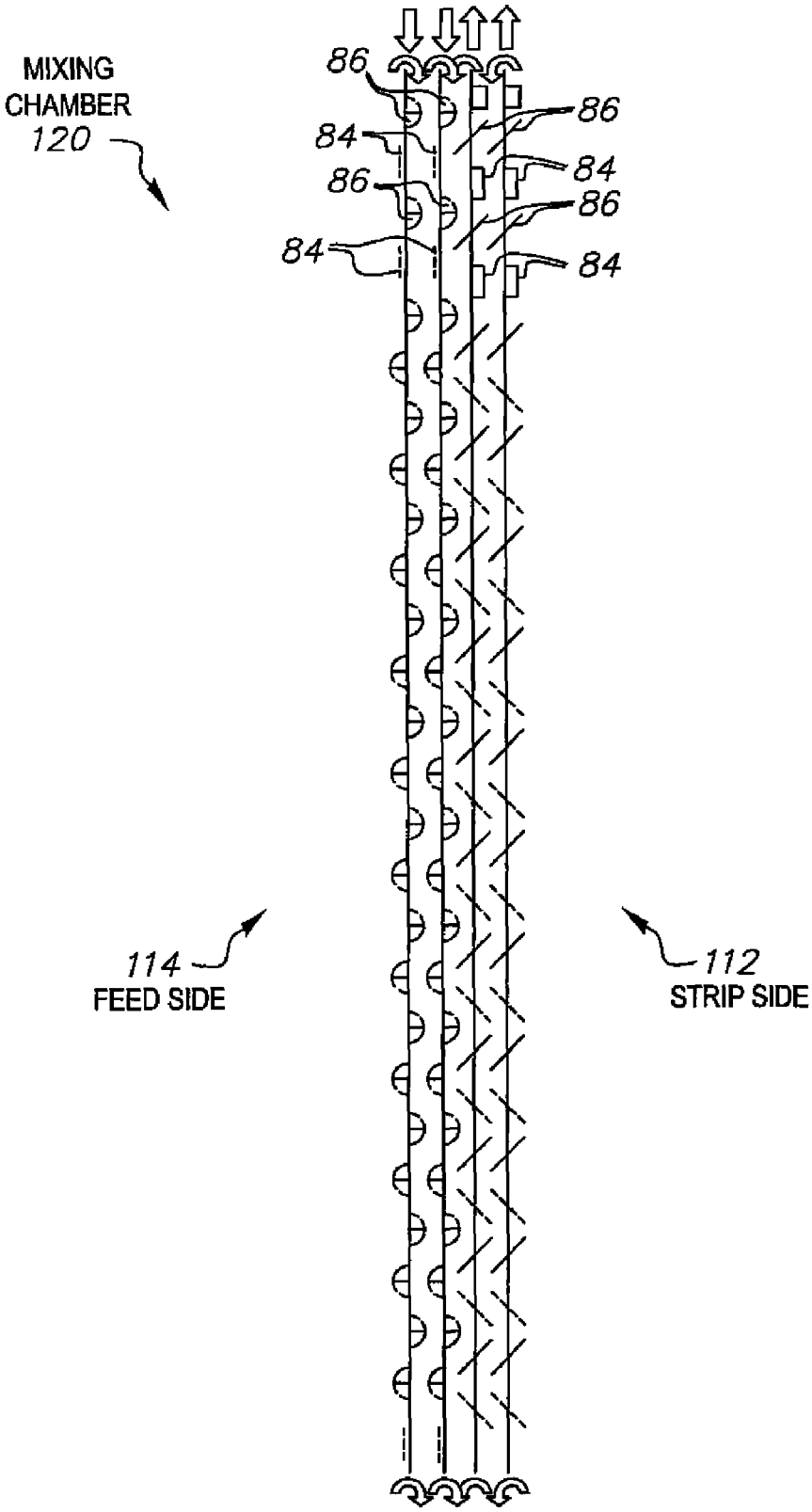
FIG. 12 is a top view schematic of one embodiment of the present invention.

Another embodiment of this invention is shown in FIG. 12. The powder conveying apparatus 52, according to this embodiment of the invention, has the indicated paddles 86 in the mixing zone that are all at the same angular orientation, interspersed with flippers.

Figure 13:
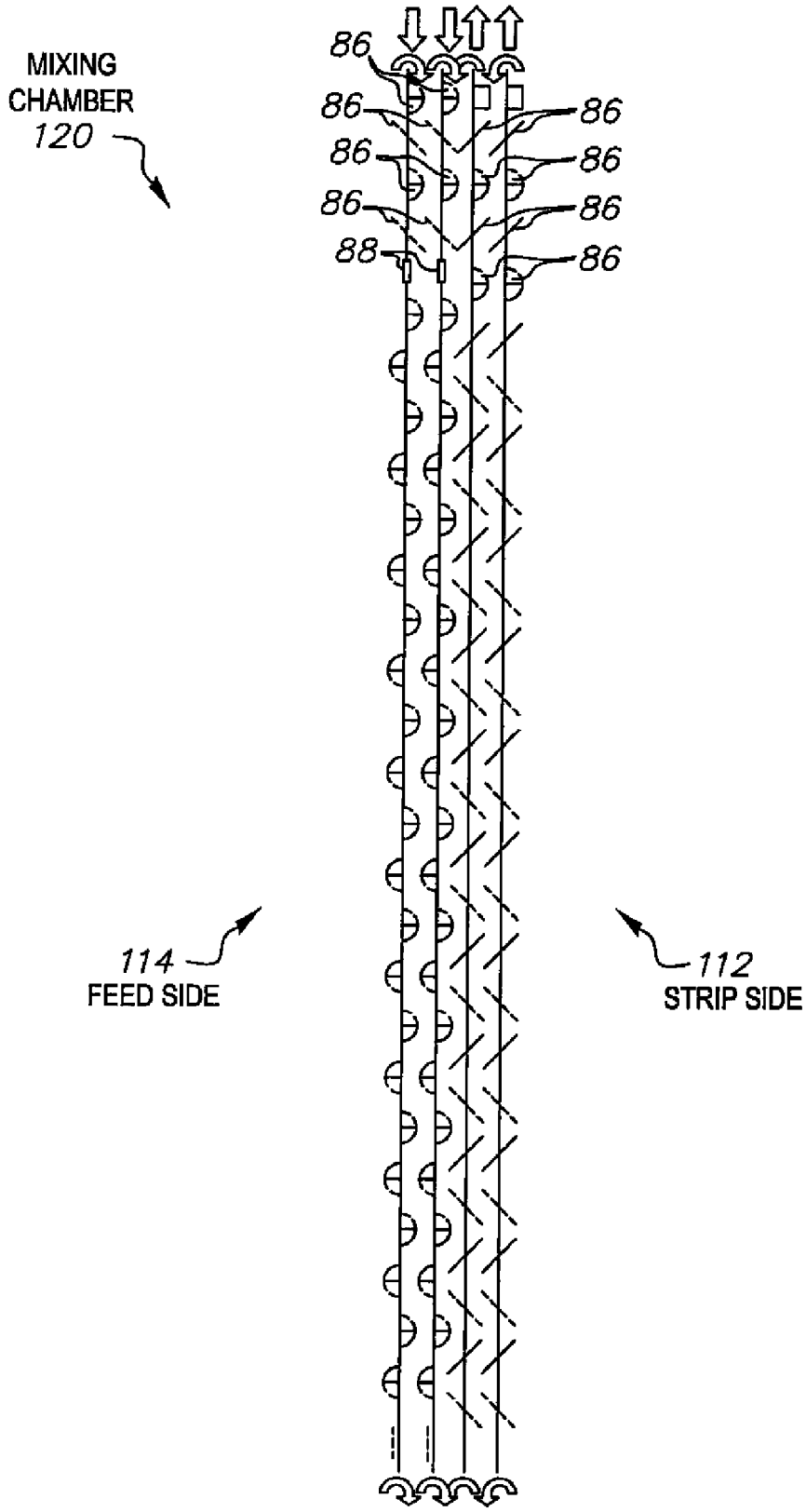
FIG. 13 is a top view schematic of one embodiment of the present invention.

Another embodiment of this invention is shown in FIG. 13. The powder conveying apparatus 52, according to this embodiment of the invention, has adjacent indicated paddles 86 on each auger in the mixing zone that are 270 degrees apart, to increase developer agitation and intermixing in each auger assembly. The necessary offset between auger assemblies is provided by spacers 88 at the edge of the mixing zone on the feed side. Similar arrangements of adjacent paddles in the mixing zone are possible, such as adjacent paddles at an angle of 90 degrees apart. Auger segments arranged 90 degrees apart or 270 degrees apart form "scoops" that move developer for one auger assembly transversely to another auger assembly.

Figure 14:
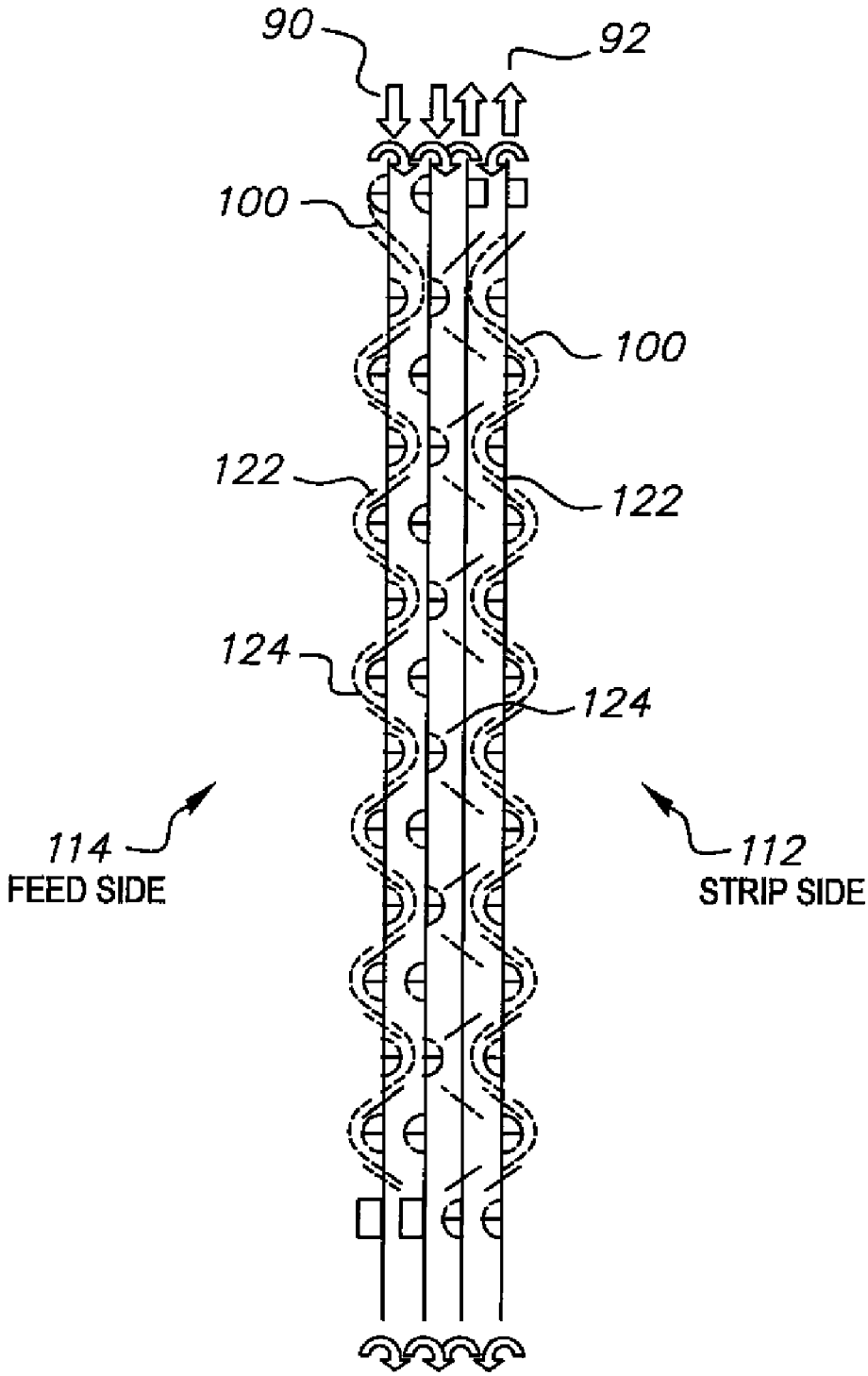
FIG. 14 is a top view schematic of one embodiment of the present invention.

The embodiment shown in FIG. 14 shows augers with auger segments orientated at 0°, 90°, 180°, 270° for the outer augers 122 of each pair of of an auger assembly 56. The inner augers 124 use 0°, 180°, 0° orientated segments of an auger assembly 56. This provides more continuous flow along the outside of the channel and less mixing between the auger assemblies and between the feed channel 114 and the strip channel 112. The outer augers 122 in FIG. 14 can contain a continuous helix 100 and the inner augers 124 can contain an interrupted or discontinuous helix or screw. A continuous helix in the outer augers provides more uniform transport and feed of developer than an interrupted helix or individual paddles. A mixing chamber containing either paddles or flippers that break the pattern of these paddles can be implemented with this configuration.

Figure 15:
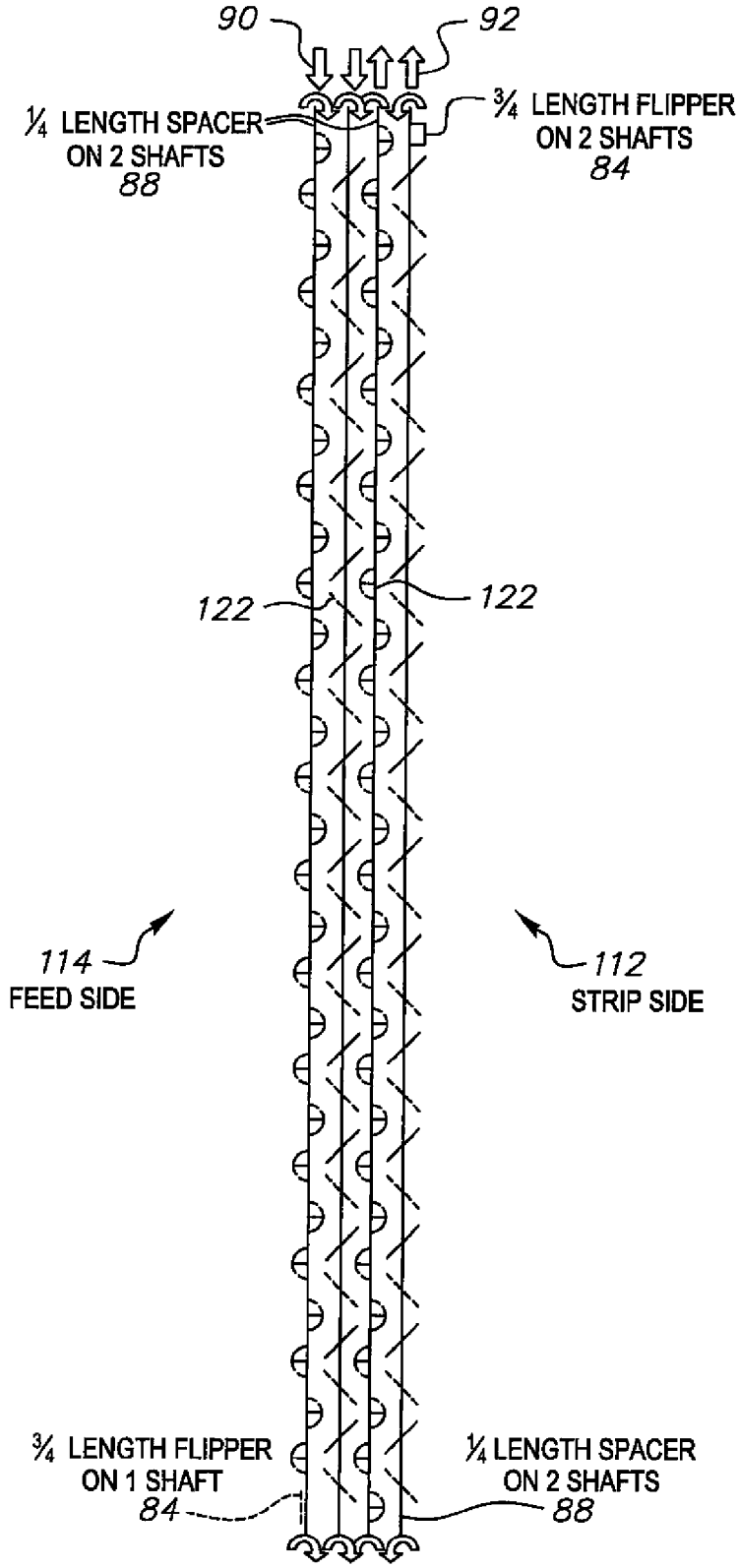
FIG. 15 is a top view schematic of one embodiment of the present invention.

FIG. 15 shows another embodiment of this invention including the powder conveying apparatus 52 having inner augers 122 in each auger assembly that are rotated 90 degrees in the direction of shaft rotation with respect to the outer augers 124 and offset ½ paddle length relative to the outer augers.

Figure 16:
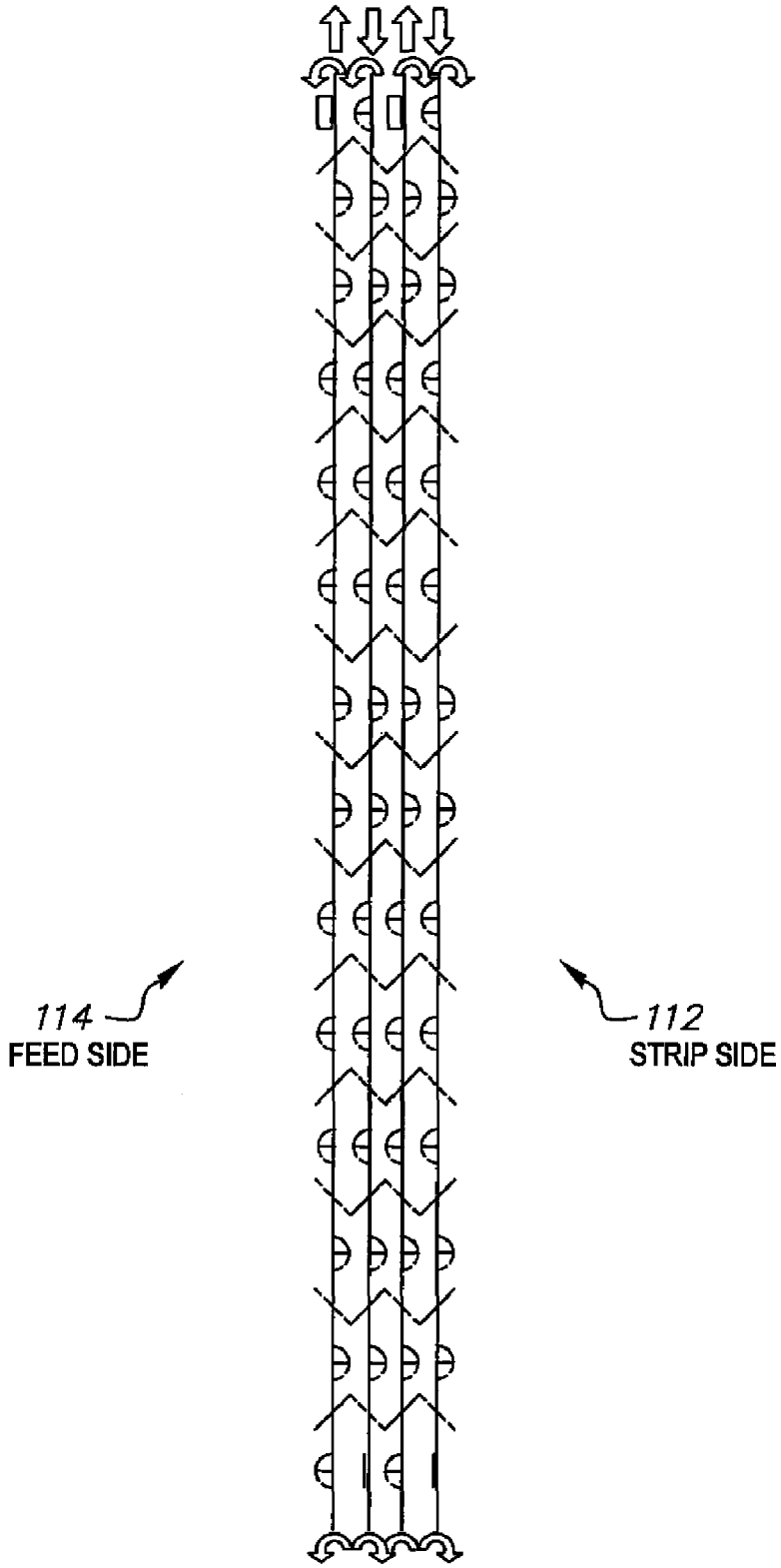
FIG. 16 is a top view schematic of a powder conveying device.

In the powder-conveying device is shown in FIG. 16, all the augers in the device are identical and differ only in orientation. The paddles used in this conveying device are right handed, angled at 30 with respect to a plane perpendicular to the auger axis. Each auger rotates in the opposite direction from the adjacent augers. This device was used as a standard to compare test results from the above-described embodiments. The tests showed many differences between the described embodiments and other powder-conveying devices, which represented unexpected results and improvements over other powder-conveying devices.

Mixing performance was tested by first filling each developer sump with Kodak P1 developer containing a polyester toner and magnetically hard ferrite carrier, adding enough P1 toner in the beginning of the feed channel to change the toner concentration by 1 weight percent overall, and then running the sump and periodically measuring toner concentration at 10 to 15 locations in the sump. The variance of the toner concentration measurements made at each measurement time was calculated. The variance decreased approximately exponentially with time. The exponential time constant for the configuration shown in FIG. 8 was 3.13 seconds. The exponential time constant for the configuration shown in FIG. 9 with a mixing chamber was 1.46 seconds. The exponential time constant for the prior art configuration shown in FIG. 16 was 37.3 seconds. These results show an improvement in mixing time for the invention compared to the prior art. The paddles and flippers used for each configuration are identical. The configuration shown in FIG. 8 changes the direction of shaft rotation for the outer augers and changes the angular orientation of the paddles with respect to each other on each shaft, as well as differences in the configuration of the flippers at the ends of the augers. The same number of flippers was used for the configuration shown in FIG. 8 and the configuration shown in FIG. 16. For the configuration shown in FIG. 9, additional flippers were used for a mixing chamber, which improved the mixing time.

The invention has been described in detail with particular reference to certain preferred embodiments thereof, but it will be understood that variations and modifications can be effected within the spirit and scope of the invention.

The invention claimed is:

1. A developing apparatus for transporting powder, containing at least powder and magnetic carrier moving toward a feed apparatus in a developer station, the apparatus comprising:

a. a development station housing defining two or more channel profiles to support a powder conveyance device comprising two or more auger assemblies rotating in opposite directions;

b. each auger assembly comprising two or more adjacent augers rotating in the same direction having multiple intermeshed screw blades that fit the channel profile such that the auger assembly preferentially mixes and transports powder in a preferred direction along the axis of the auger with minimal cross mixing between auger assemblies while allowing intermixing in the assembly; and c. a conveyance controller for controlling the powder conveying device, including the two or more auger assemblies having mixing and transport areas while conveying the powder toward the feed apparatus.

2. The developing apparatus of claim 1, the screw augers comprising intermeshed blades comprising a helical portion.

3. The developing apparatus of claim 1 further comprising a partition between the auger assemblies.

4. The developing apparatus of claim 1, further comprising angled paddles wherein an angled paddle angle ranges from 20 to 40 degrees.

5. The developing apparatus of claim 1, further comprising angled paddles wherein an angled paddle orientation ranges from 90 to 180 degrees.

6. The developing apparatus of claim 1, each auger assembly comprising two or more augers having left-handed blades.

7. The developing apparatus of claim 1, the adjacent augers of each auger assembly are offset ½ paddle length and 90 degrees out of phase during one portion of the rotation.

8. The developing apparatus of claim 1, the conveyance controller further controlling the offset of adjacent augers of each auger assembly.

9. The developing apparatus of claim 1, the mixing area contains at least one flipper.

10. The developing apparatus of claim 9, having one or more flipper on each shaft where the adjacent blades are offset between 90 and 180 degrees to each other.

11. The developing apparatus of claim 1, the blades having an overlap range between 0.5x and 0.95 x, where x represents the distance between two adjacent auger shafts in the auger assembly.

12. A method of conveying powder to a development roller, the method comprising:

a. moving the powder using a powder conveying device comprising two or more assemblies rotating in opposite directions, each assembly comprising two or more intermeshed powder conveying screw augers having multiple screw blades rotating in the same direction; and b. controlling the spacing between the two or more augers in each conveying device such that the auger preferentially mixes in the assembly and transports in a preferred direction along the axis of the auger with minimal cross mixing between auger assemblies simply using auger rotation as the powder conveying device conveys the powder toward a feed apparatus.

13. The method of claim 12, the method further comprising controlling the blade angle ranges from 20 to 40 degrees.

14. The method of claim 12, the method further comprising a blade (paddle) orientation from 90 to 180 degrees.

15. The method of claim 12, the method further comprising a blade angle range from 20-40 degrees and a blade (paddle) orientation from 90 to 180 degrees.

16. The method of claim 12, the method further comprising controlling a direction of the rotation of the blade.

17. The method of claim 12, the method further comprising controlling a blade wall distance to further control the volume of powder and magnetic carrier that is preferentially mixed or pushed.

18. The method of claim 12, the method further comprising controlling a conveyance controller.

19. A developing apparatus for transporting powder, containing at least powder and magnetic carrier moving toward a feed apparatus in a developer station, the apparatus comprising:

a. a development station housing defining two or more channel profiles to support a powder conveyance device comprising two or more auger assemblies rotating in opposite directions;

b. each auger assembly comprising two or more adjacent augers rotating in the same direction having multiple intermeshed angled screw blades that fit the channel profile such that the auger assembly preferentially transports powder in a preferred direction in a preferred direction along the axis of the auger with minimal cross mixing between auger assemblies while allowing intermixing in the assembly c. one or more flipper in a mixing area separate from the transport area; and d. a conveyance controller for controlling the offset of adjacent augers of each auger assembly powder conveying device, including the two or more auger assemblies having a mixing and transport areas while conveying the powder toward the feed apparatus.

20. The developing apparatus of claim 19, the one or more flipper are located on each shaft and adjacent blades are offset between 90 and 180 degrees to each other.

* * * * *